US006073475A

United States Patent [19]

Offoiach

[11] Patent Number: 6,073,475

[45] Date of Patent: Jun. 13, 2000

[54] SERVO-ASSISTED ROLLING STAND

[75] Inventor: Renzo Offoiach, Tarcento, Italy

[73] Assignee: S.I.M.A.C. S.p.A., Tarcento, Italy

[21] Appl. No.: 09/254,997

[22] PCT Filed: Oct. 2, 1997

[86] PCT No.: PCT/IT97/00237

§ 371 Date: May 12, 1999

§ 102(e) Date: May 12, 1999

[87] PCT Pub. No.: WO98/15365

PCT Pub. Date: Apr. 16, 1998

[30] Foreign Application Priority Data

Oct. 7, 1996 [IT] Italy ..... UD96A0188

[51] Int. Cl.[7] ..... B21B 31/07; B21B 31/32

[52] U.S. Cl. ..... 72/245; 72/237

[58] Field of Search ..... 72/245, 225, 237, 72/248, 238, 239

[56] References Cited

U.S. PATENT DOCUMENTS 4,715,206 12/1987 Forni ..... 72/245

*Primary Examiner*—Rodney Butler

*Attorney, Agent, or Firm*—Harrison & Egbert

[57] ABSTRACT

A rolling stand having a stand casing, a first cylinder holding packing having a rolling cylinder rotatably mounted therein, a second cylinder holding packing having a rolling cylinder rotatably mounted therein with a rolling axis in parallel relation to the rolling axis of the rolling cylinder of the first cylinder holding packing, and four tie rods positioned at respective comers of the stand casing and each having a right-hand screw and a left-hand screw threadedly connected respectively to the cylinder holding packings so as to move at least one of the packings relative to the other. One of the cylinder holding packings includes an external bridge part coupled to the tie rods at either the right-hand screw or the left-hand screw, an internal part directly receiving the cylinder therein and coupled to the tie rods along an unthreaded portion of each of the tie rods, and a fluid dynamic cylinder connected to the external bridge part and to the internal part. The fluid dynamic cylinder moves the internal part toward or away from the external bridge part or for exerting a pressure onto the internal part relative to a predetermined amount of fluid introduced or removed from the fluid dynamic cylinder.

8 Claims, 3 Drawing Sheets

SERVO-ASSISTED ROLLING STAND

TECHNICAL FIELD

This invention relates to a rolling stand with servoassisted adjustment.

BACKGROUND ART

In prior art it is known the advantage of adjusting automatically during the rolling process the position of the rolling cylinders to adapt progressively the pass thickness to the needs of progressive reduction of the thickness of the rolled section.

It is known that the rolling products, during their rolling, have a temperature variableness in their length and therefore a yielding variableness (compression strength or pressing strength) which determines different loads on the cylinders, that is different yielding of the structure.

Thus if the tail of a rod is colder than the head, during the rolling, the thickness of the rolled section tends to be higher on the tail because of a slight yielding of the cylinders which under a higher stress are more spaced (presence of unavoidable slacks and higher bending stress), or vice-versa in warmer areas of the rolled section.

The others presence of different temperatures (e.g., between head and tail) causes the problem of lack of size homogeneity in the traditional stands of obtaining products because of the different rolling loads deriving from the uneven temperatures.

This results in the difficulty rolled products with lower tolerances with the traditional rolling stands, particularly for the rolling of long products.

The servoassisted adjustment of the rolling cylinders is traditionally adopted for the rolling of large products, that is sheet plates, bands and large flats. This is carried out by using a quarter-stand involving two upper hydraulic jacks which press on the upper cylinder so to adjust it automatically in lowering and lifting.

Thus by suitable servocontrols of the prior art it is possible to automatically adjust the pass thickness during the rolling phase.

The same need exists presently in the hot rolling of long products (wire-rod, wire, rod, rod sections, etc.).

The existing adjustment art for the rolling of long products is still carried out mechanically by manual screw systems or by electro-controlled reduction gears which require a lot of maintenance.

A related solution using a servo-assisted adjustment stand was proposed by the present invention in another patent application (Italian Application No. IT-UD94A00189). This proposed solution proposes a two-high rolling stand, of the type involving moving orthogonally the respective cylinders removing and approaching them from one another by the sliding of the respective cylinder-holding packings along four tie-rods placed at the respective four angles of the stand, where at least at one end of each of the tie-rods, is applied an hydraulic jack which, fastened to the end of each of the tie-rods, acts by pressure or by retraction against the respective packing which carries the respective rolling cylinder.

This solution has the problem of moving the whole stand and is very complex.

Document SU-A-1205952 discloses a universal stand rolling mill providing the division of the upper cylinder-holding packing into two parts, the upper part being connected to tie rods with threads and comprising a single hydraulic cylinder, being also the lower part of the upper packing connected to the rods via threads.

The purpose of this invention is that of considerably simplifying the self-adjustment system of the distance between the cylinders for the rolling stand, which can be a two-high or a three-high stand, both before and during the rolling so that the cylinders modify their distance according to the variation of the characteristics of the section being rolled.

SUMMARY OF THE INVENTION

These and other purposes achieved by a two-high rolling stand, which moves the respective cylinders orthogonally with respect to the rolling axis and approaching and moving away from each other by the sliding of the respective cylinder-holding packings along four tie-rods placed at the respective four angles of the stand's case, each threaded by right-hand and left-hand screws opposite to one another for moving the upper cylinder-holding packing and the lower cylinder-holding packing in opposition. The stand includes:

at least one of the packings is made up of two parts;

an external bridge part which is tied by coupling to the respective right-hand or left-hand threadings of the rods; and an internal part which makes up the cylinder-holding packing, which is guided and slides axially along the tie-rods into a corresponding unthreaded part of these same, and in which the external bridge part is connected and tied to said internal cylinder-holding part by at least one approaching/spacing means with a fluid-dynamic cylinder able to move away or approach or press the internal part which makes up said cylinder-holding packing relative to the bridge on the base of a determined amount of fluid let in or let out by the approaching/spacing means.

Thus the rolling problems are solved in a simple and safe way. It is possible to carry out in a precise and reliable way a complete automatic adjustment of the pass depths during the rolling.

This solution differs from the others because the continuous micro-spacing between the rolling cylinders during the rolling phase is not obtained by screw systems but with a fluid-dynamic system by removal or introduction of a predetermined volume of fluid in said approaching/spacing means.

This solution is also much more simple and reliable relative to the previous solution taught by the IT-UD94A000189 of the same applicant, where it was suggested the use of four hydraulic cylinders (jacks) connected directly to the tie-rods inserted in the packings.

Advantageously the four tie-rods are kept in a fixed position by a base or retaining case which supports a retaining and guiding quadrangular semi-case which, besides maintaining in position the tie-rods, contains and guides the respective cylinders-holding packings.

Also advantageously the four tie-rods are controlled rotationally in unison by an upper gear transmission system (preferably with a worm screw transmission driven by a varying-gear motor of known art).

The control of the fluid-dynamic cylinders (oil-hydraulic) is obtained as per traditional art by feeding through servovalves, safety valves and locking valves. The system pressure is assured by an hydraulic station and by a system of accumulators.

In the station the fluid is conditioned, that is filtered, cooled or heated, by means of a separate circuit.

The control of the cylinder's position is assured by the linear transducers connected to the movement of the packings and by pressure measurers which are inserted in the same hydraulic jacks.

Some small blocks may be provided which slide on vertical guides for the axial locking of the rolling cylinders. The system for the fluid inlet to the hydraulic jacks (cylinders) may be adjusted also by optical sensors of the temperature of the advancing rolled section or also by measurers (for example laser measurers) of the variation of the rolled section, etc.

The advantages obtained by this solution are as follows position control (port between the rolling cylinders) during the rolling.

the ability to correct in a very short time;

higher precision in the positioning, that is in setting the calibration;

control of the rolling scraps through the control of the hydraulic pressure with no insertion of load cells.

the ability to obtain rolled products with smaller tolerances along the entire rod length also in the presence of different temperatures (e.g. between head and tail) which with traditional stands would cause products not dimensionally homogeneous because of the different rolling loads deriving from the uneven temperatures;

the ability to automate and control the rolling mill in real times;

simpler and more economical; and more compactness in the rolling equipment.

These and other advantages will appear from the following description of a preferred simplified embodiment solution relative to the enclosed drawings.

Figure 4:
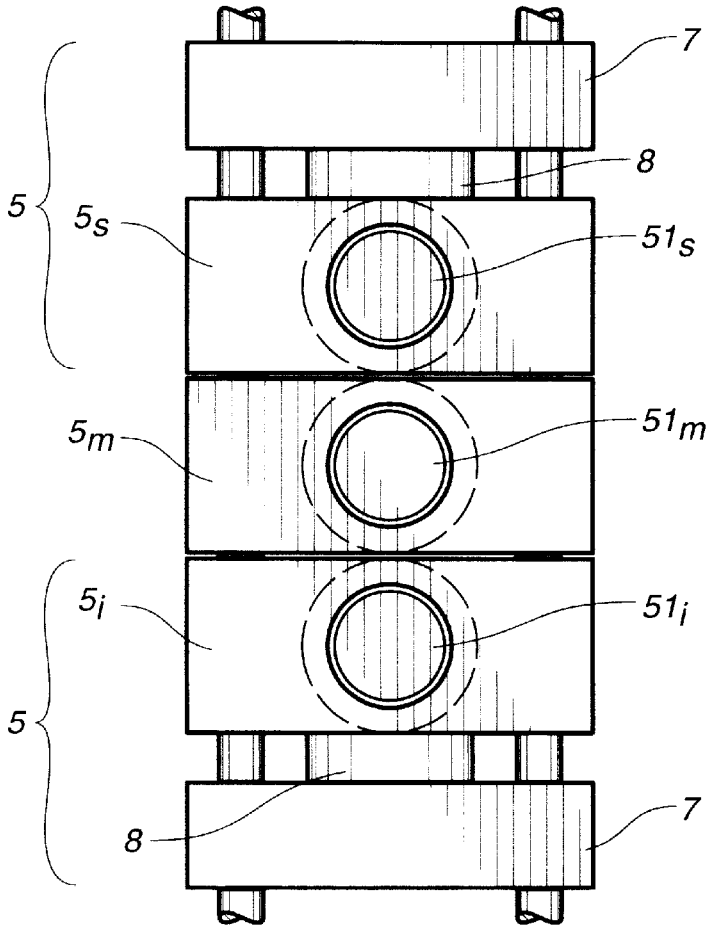

Of course the solution in FIG. 4 may be applied also to a two-high stand.

DETAILED DESCRIPTION OF THE INVENTION

In the figures, the base 9 is shown as a containing base of the entire rolling group.

The containing base 9 supports a demountable case 91, upturnable by screw means 92, 93 which guides vertically the respective cylinder-holding packings, upper 5*s* and lower one 5*i* which include the respective rolling cylinders (51*s*, 51*i*).

The same case 91 holds and guides vertically the four tie-rods (1–2; 3–4) which respect to this same may only rotate freely, but not change position.

The rotation of the four tie-rods is absolutely alike and driven by a transmission system with geared upper bridge of the known art (0).

Each of the four tie-rods 1,2,3,4 have two threaded sections respectively with right-hand threading (V1) and with left-hand threading (V2) or vice-versa, an upper one and a lower one.

According to the invention the upper packing group (5) is split into a cylinder-holding packing and into an upper bridge 7 7 which is moved by the threaded coupling (v) and is connected to the packing by interconnection with the approaching-removing means either of higher or lower pressure with hydraulic jacks (8) which carries out the continuous movement respect to said bridge 7.

Figure 1:
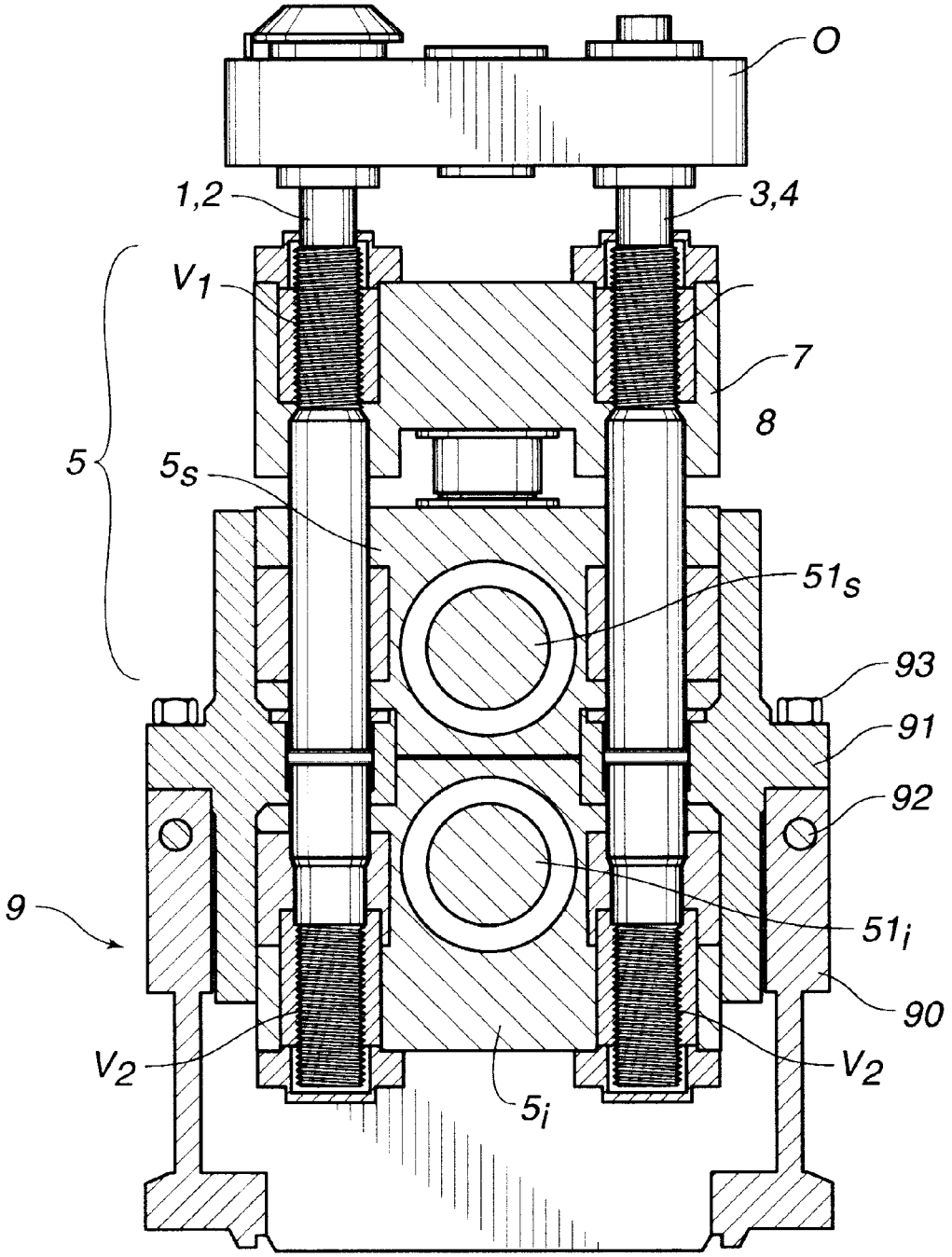
FIG. 1 is a cross-sectional schematic view on the vertical plan orthogonal respect to the cylinders axis, passing through a couple of tie-rods of a rolling stand with servoassisted adjustment according to this invention.
Figure 2:
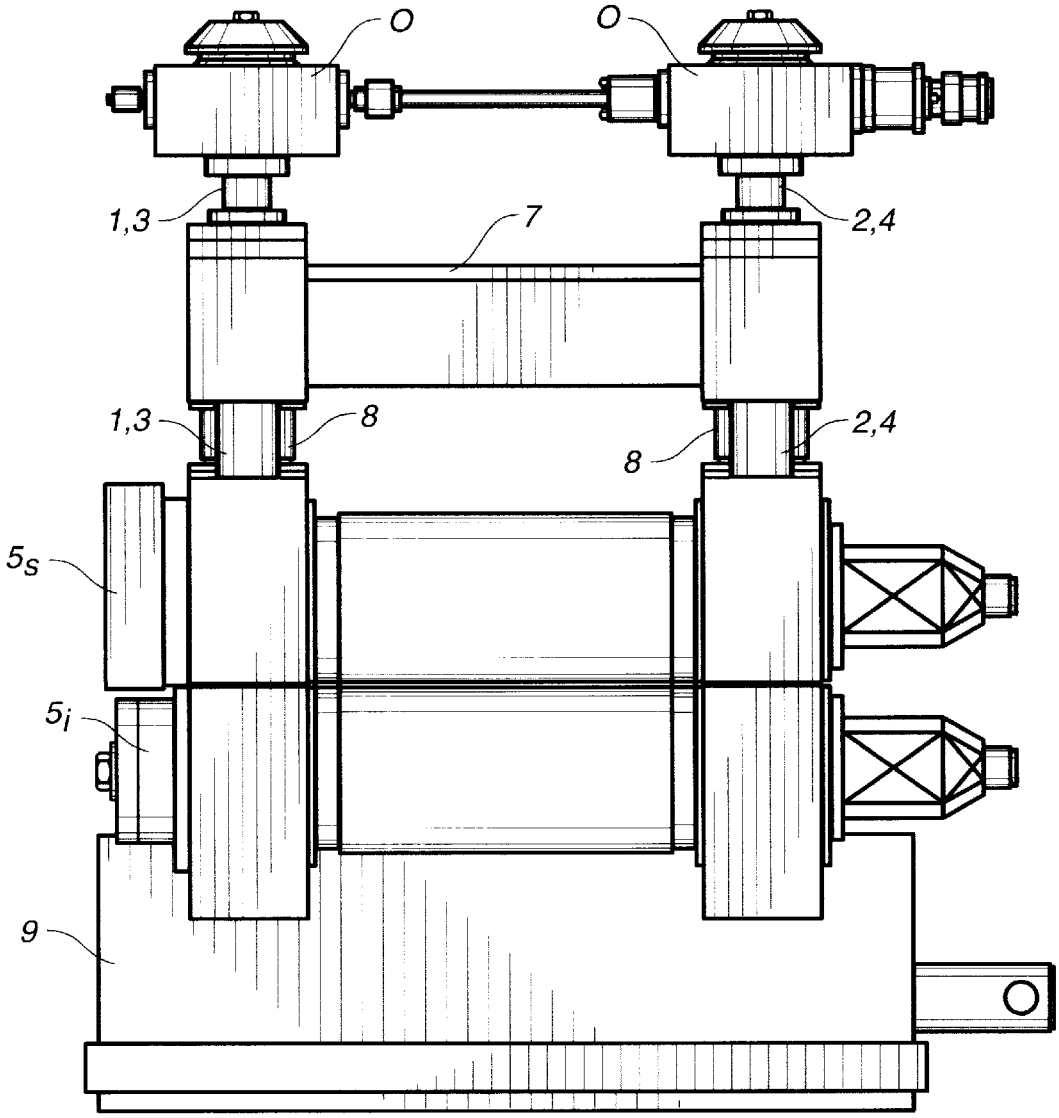
FIG. 2 is a front schematic view.

In FIG. 1, the lower threading (V2) couples with the lower packing 5*i* and the upper threading (V1) instead of coupling as in the traditional solutions with the upper packing, couples with an upper bridge 7.

The upper packing instead is free to slide along the tie-rods (1–2; 3–4), and is tied to the upper bridge by said approaching/removing means with higher or lower pressure with fluid-dynamic cylinder (8).

In such a way, it is possible to move the lower packing 5*i* in alignment with the rolling axis and then during the rolling, to move or to press the upper packing (5*s*) continuously in relation to the necessary rolling standards and then the respective upper rolling cylinder (51*s*) relative to the lower packing (5*i*) and respective lower cylinder supported by it (51*i*), which instead remain fixed.

The slight variation of the rolling axis results as having no effect considering the infinitesimal variation of the positions.

Figure 3:
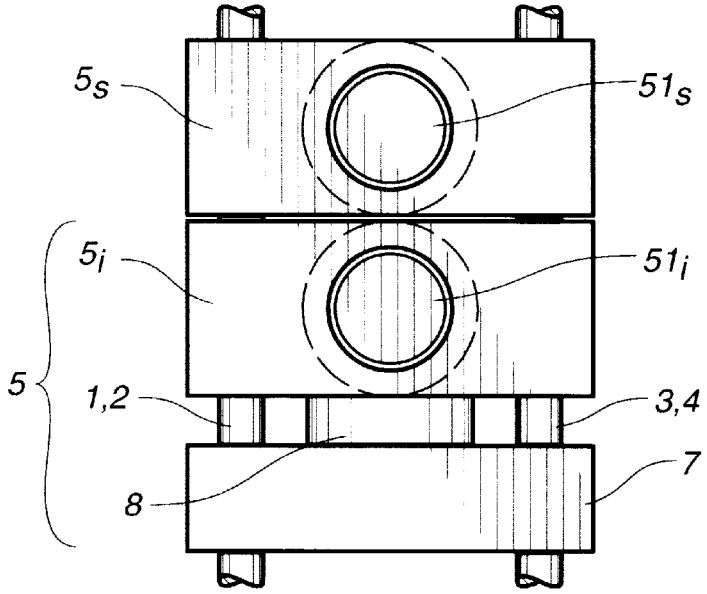
FIGS. 3 and 4 represent schematically other two solutions, respectively the first one spread out flat respect to the solution of FIGS. 1 and 2 and the second one with the application of the above mentioned device in the specific case for a three-high stand.

FIG. 3 represents a similar but upturned solution in which the lower packing 5*i* to be split and supported by the lower bridge 7 and moved by the approach/removal means with higher or lower pressure with fluid-dynamic cylinder (8) placed between them, while the upper packing (5*s*) with respective cylinder (51*s*) would remain fixed.

In the three-high solution of FIG. 4, the intermediate packing 5*m* and respective intermediate cylinder 51*m* would remain fixed, while both packings and upper and lower cylinders (5*s*–51*s*; 5*i*–51*i*) would be moved, both moved in turn by a respective supporting bridge (7) with the approaching/removing means with higher or lower pressure with interconnection fluid-dynamic cylinder (8).

Linear transducers (position sensors) (not shown, of the known art) supply data to the control central unit (not shown) for determining the hydraulic delivery line oil to the respective hydraulic jacks which make up the approaching/removing means with higher or lower pressure (generally a jack on each side of cylinder 8 in relative to the pairs of housings at the height of the supporting shoulders and between each couple of tie-rods 1–2; 3–4) for the desired adjustment In this way it is possible to adjust in a simple, reliable and safe way the rolling cylinders as wished also during the rolling phase.

What is claimed is:

1. A rolling stand comprising:

a stand casing;

a first cylinder holding packing having a rolling cylinder rotatably mounted therein;

a second cylinder holding packing having a rolling cylinder rotatably mounted therein with a rolling axis in parallel relation to a rolling axis of said rolling cylinder of said first cylinder holding packing; and four tie rods positioned at respective comers of said stand casing, each of said four tie rods having a right-hand screw and a left-hand screw threadedly connected respectively to said first and second cylinder holding packings so as to move at least one of said first and second cylinders holding packings relative to the other of said first and second cylinder holding packings, one of said first and second cylinder holding packings comprising:

an external bridge part coupled to said tie rods at either said right-hand screw or said left-hand screw;

an internal part directly receiving the cylinder therein, said internal part coupled to said tie rods along an unthreaded portion of each of said tie rods; and a pressure variation means having a fluid dynamic cylinder connected to said external bridge part and said internal part, said pressure variation means for moving said internal part toward or away from said external bridge part or for exerting a pressure onto said internal part relative to a predetermined amount of fluid introduced into or removed from said fluid dynamic cylinder.

2. The rolling stand of claim 1, said stand casing comprising:

a base; and a casing retained within said base, said four tie rods being fixedly and rotatably mounted in said casing, said base having a quadrangular configuration which matingly receives said casing.

3. The rolling stand of claim 1, further comprising:

an upper transmission system connected to said four tie rods so as to rotate said four tie rods in unison.

4. The rolling stand of claim 1, further comprising:

control means connected to said pressure variation means for controlling a volume of the fluid introduced or removed from said fluid dynamic cylinder relative to variations in material rolled between said cylinders.

5. The rolling stand of claim 1, further comprising:

control means connected to said pressure variation means for controlling a volume of the fluid introduced or removed from said fluid dynamic cylinder based on a distance measured between said first and second cylinder holding packings.

6. The rolling stand of claim 1, further comprising:

control means connected to said pressure variation means for controlling a volume of the fluid introduced or removed from said fluid dynamic cylinder based upon a pressure exerted by one of said first and second cylinder holding packings upon the other of said first and second cylinder holding packings.

7. The rolling stand of claim 1, further comprising:

control means connected to said pressure variation means for controlling a volume of the fluid introduced or removed from said fluid dynamic cylinder based upon a temperature or temperature variation of material passing between said cylinders.

8. The rolling stand of claim 1, further comprising:

control means connected to said pressure variation means for controlling a volume of the fluid introduced or removed from said fluid dynamic cylinder based upon a size of material passing between said cylinders.

* * * * *